US008794542B1

(12) United States Patent
Hunter et al.

(10) Patent No.: US 8,794,542 B1
(45) Date of Patent: Aug. 5, 2014

(54) SPRINKLER WITH TOP-SIDE REMOTELY VENTED PRESSURE REGULATOR

(75) Inventors: Daniel E. Hunter, Vista, CA (US); Michael L. Clark, San Marcos, CA (US)

(73) Assignee: Hunter Industries, Inc., San Marcos, CA (US)

( * ) Notice: Subject to any disclaimer, the term of this patent is extended or adjusted under 35 U.S.C. 154(b) by 577 days.

(21) Appl. No.: 12/475,423

(22) Filed: May 29, 2009

(51) Int. Cl.
*B05B 3/04* (2006.01)

(52) U.S. Cl.
USPC ..... 239/240; 239/201; 239/204; 239/239; 239/571

(58) Field of Classification Search
CPC ..... B05B 3/04; B05B 1/3013; B05B 1/304; B05B 3/0431; B05B 3/0422; B05B 1/30; B05B 1/3006; B05B 15/10
USPC ..... 239/200, 201, 203–206, 237–240, 242, 239/263, 263.3, 273, 571; 137/217, 517, 137/522, 523
See application file for complete search history.

(56) References Cited

U.S. PATENT DOCUMENTS

| | | | | | |
|---|---|---|---|---|---|
| 4,568,024 | A * | 2/1986 | Hunter | 239/242 |
| 4,718,605 | A | 1/1988 | Hunter | 239/242 |
| 4,913,352 | A | 4/1990 | Witty et al. | 239/104 |
| 5,090,446 | A | 2/1992 | Hunter et al. | 137/540 |
| 5,257,646 | A | 11/1993 | Meyer | 137/505.25 |
| 5,293,898 | A * | 3/1994 | Masloff | 137/517 |
| 5,456,411 | A | 10/1995 | Scott et al. | 239/73 |
| 5,699,962 | A | 12/1997 | Scott et al. | 239/73 |
| 5,762,270 | A * | 6/1998 | Kearby et al. | 239/205 |
| 5,779,148 | A | 7/1998 | Saarem et al. | 239/104 |
| 5,979,863 | A | 11/1999 | Lousberg | 251/30.02 |
| 6,042,021 | A | 3/2000 | Clark | 239/205 |
| 6,050,502 | A | 4/2000 | Clark | 239/237 |
| 6,241,158 | B1 | 6/2001 | Clark et al. | |
| 6,293,348 | B1 | 9/2001 | Reilly | |
| 6,666,277 | B2 | 12/2003 | Reilly | |
| 6,997,393 | B1 | 2/2006 | Angold et al. | 239/205 |
| 7,017,831 | B2 | 3/2006 | Santiago et al. | 239/222.13 |
| 7,287,711 | B2 * | 10/2007 | Crooks | 239/240 |
| 7,401,622 | B2 | 7/2008 | Ungerecht | 137/315.04 |
| 7,681,807 | B2 * | 3/2010 | Gregory | 239/206 |
| 2006/0278727 | A1 | 12/2006 | Kah, Jr. | 239/67 |
| 2007/0007364 | A1 * | 1/2007 | Gregory | 239/206 |
| 2007/0119978 | A1 | 5/2007 | Wang et al. | |
| 2010/0147401 | A1 | 6/2010 | Gregory | 137/512 |

* cited by examiner

*Primary Examiner* — Jason Boeckmann
(74) *Attorney, Agent, or Firm* — Knobbe Martens Olson & Bear LLP

(57) ABSTRACT

An irrigation sprinkler includes a riser and a nozzle rotatably mounted at an upper end of the riser. A gear train reduction is mounted in the riser and a turbine is coupled to the gear train reduction for rotation by water entering a lower end of the riser. A gear driven coupling mechanism mounted in the riser couples the gear train reduction and the nozzle. A pressure regulator is mounted in the riser and is adjustable from a top-side of the sprinkler.

21 Claims, 6 Drawing Sheets

SPRINKLER WITH TOP-SIDE REMOTELY VENTED PRESSURE REGULATOR

FIELD OF THE INVENTION

The present invention relates to sprinklers used in residential and commercial irrigation for watering turf and landscaping.

BACKGROUND OF THE INVENTION

Many parts of the world lack sufficient rainfall at different times of the year to maintain the health of turf and landscaping. Irrigation systems are therefore used to deliver water to such vegetation from municipal water supplies and wells according to a watering schedule. A typical irrigation system comprises a programmable controller that turns valves ON and OFF to deliver water through a plurality of sprinklers connected to the valves via subterranean pipes. These sprinklers are usually rotor-type, impact, spray, or rotary-stream sprinklers.

SUMMARY OF THE INVENTION

In accordance with the present invention an irrigation sprinkler includes a riser and a nozzle mounted at an upper end of the riser. A pressure regulator is mounted in the riser and is remotely vented from a top-side of the sprinkler.

DETAILED DESCRIPTION

Figure 1:
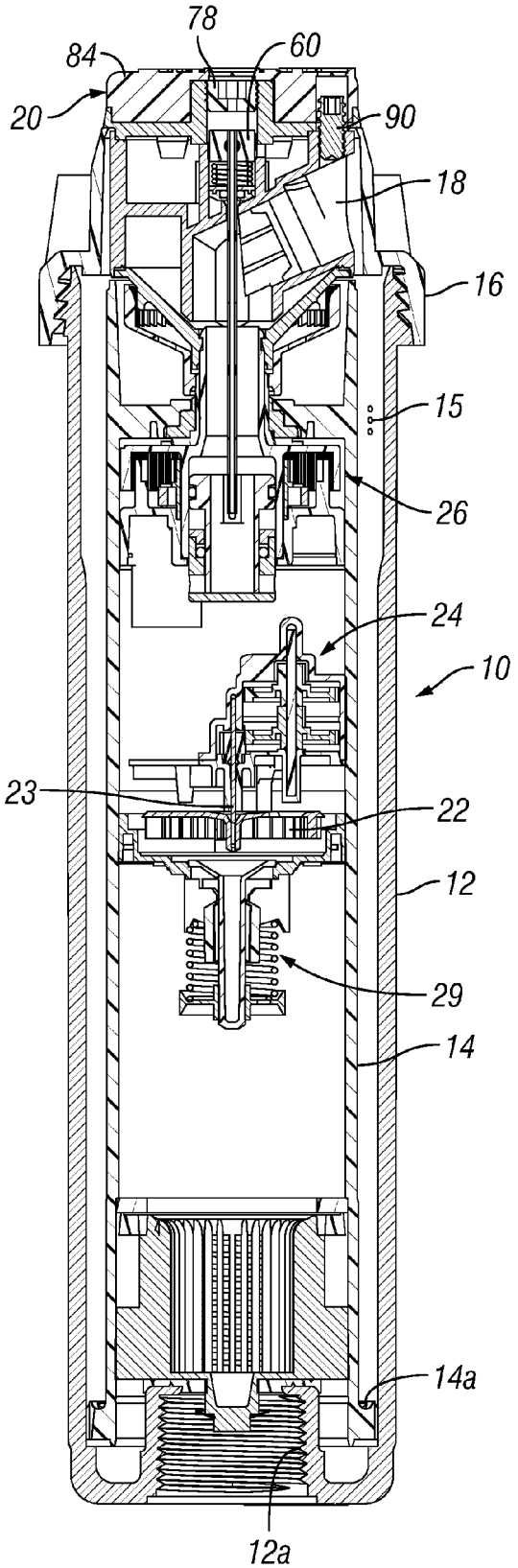
FIG. 1 is a vertical cross-sectional view of a rotor-type sprinkler with a top-side adjustable pressure regulator in accordance with an embodiment of the present invention.

Referring to FIG. 1, a pop-up rotor type irrigation sprinkler 10 is manufactured and assembled using injection molded plastic parts, metal shafts, steel springs and seals made of a suitable elastomeric material. The sprinkler 10 includes a cylindrical outer case 12 and a tubular riser 14 telescopically extensible from the outer case 12 by water pressure and normally held in a retracted position by a surrounding coil spring 15 illustrated diagrammatically in FIG. 1. The riser 14 is mounted co-axial with the case 12 and the riser 14 reciprocates vertically along its central longitudinal axis. The case 12 has a female threaded inlet 12*a* at is lower end for screwing over a male threaded fitting connected to a subterranean pipe (not illustrated) which is in turn connected to a source of pressurized water such as a solenoid-actuated diaphragm valve (not illustrated). See U.S. Pat. No. 5,979,863 granted Nov. 9, 1999 to Bradley M. Lousberg and assigned to Hunter Industries, Inc., the assignee of the subject application. A ring-shaped female threaded end cap 16 is screwed over a male threaded upper end of the case 12. The lower end of the coil spring 15 seats in an upwardly opening annular groove formed in a shoulder 14*a* of the riser 14. The upper end of the coil spring 15 seats in a downwardly opening annular groove in a rigid retainer ring (not illustrated) held in place by the end cap 16. The riser 14 can telescope through the end cap 16 to an extended position (not illustrated) when water pressure is applied at the inlet 12*a*. This compresses the coil spring 15. When the water pressure is turned OFF the force of the compressed coil spring 15 pushes the riser 14 back to its retracted position illustrated in FIG. 1. An elastomeric wiper seal (not illustrated) is positioned between the riser 14, the retainer ring and the case 12.

A nozzle 18 (FIG. 1) is removably mounted in a cylindrical turret 20 rotatably mounted at an upper end of the riser 14. A turbine 22 is mounted in the riser 14 for rotation about a vertical axis by water entering the lower end of the riser 14 after flowing through the inlet 12*a* of the case 12. The turbine 22 is mounted to the input shaft 23 of a staggered gear train reduction 24 mounted in the riser 14. An arc-adjustable reversing mechanism 26 is mounted in the riser 14 and couples an output shaft (not illustrated) of the gear train reduction 24 and the nozzle turret 20. The reversing mechanism 26 may provide the ability for the turret 20 to rotate in continuous direction, or it may provide the ability for the turret 20 to oscillate, changing direction back and forth, within a pre-selected arc of rotation. A remotely vented pressure regulator 28 (FIG. 3) is mounted above the gear train reduction 24 and extends through the turret 20. The pressure regulator 28 is configured for adjustment from a top-side of the sprinkler 10 to reduce the radius of the wetted area by reducing the pressure of the water entering the nozzle 18. A spring-biased stator 29 (FIG. 1) is mounted in the lower portion of the riser 14 beneath the turbine 22 for controlling the RPM of the turbine 22.

Figure 2A:
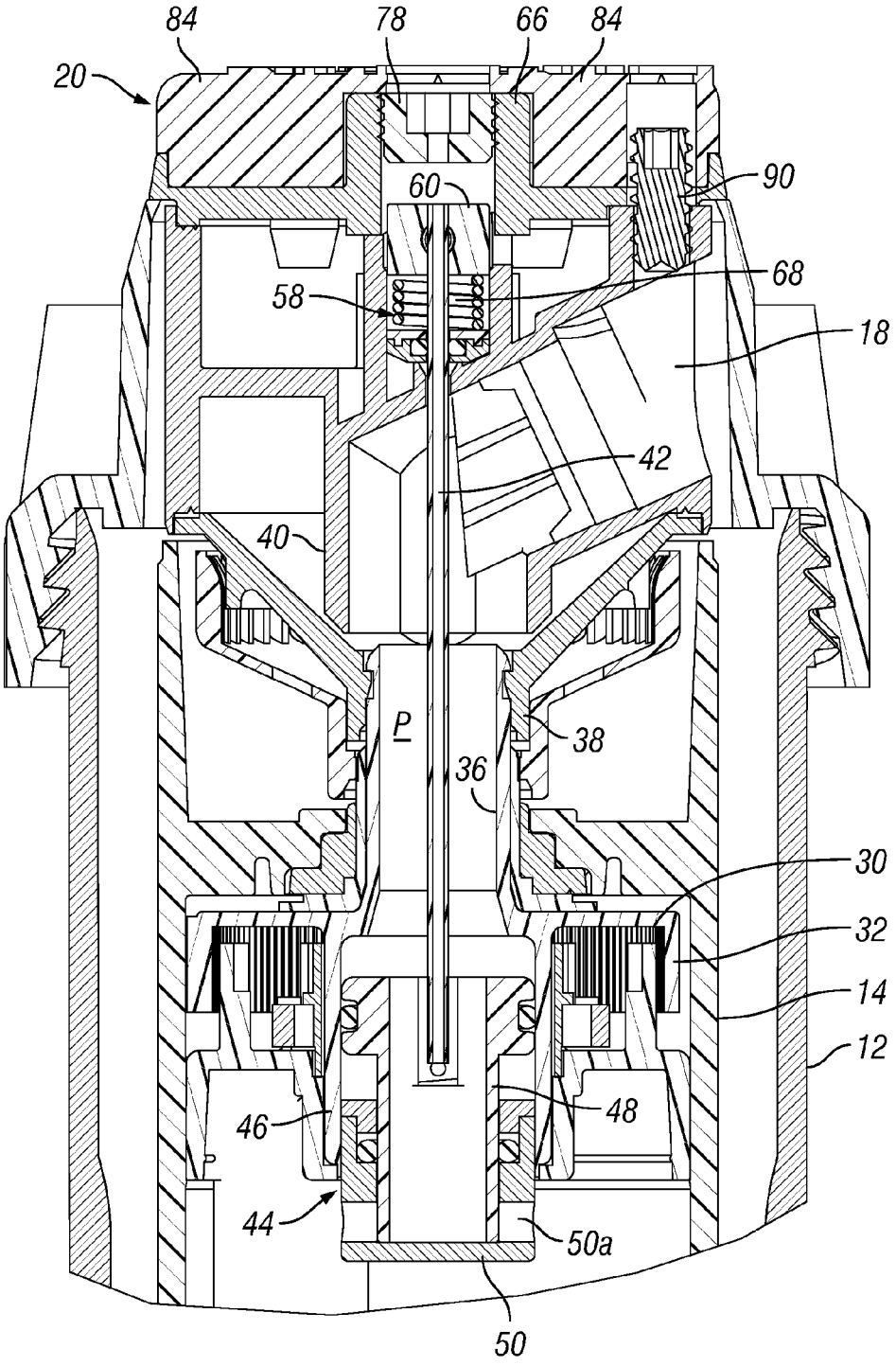
FIG. 2A is a greatly enlarged portion of FIG. 1 illustrating details of the adjustable pressure regulator with its valve portion in the fully closed configuration.

The reversing mechanism 26 is preferably of the type disclosed in U.S. Pat. No. 7,287,711 granted Oct. 30, 2007 to John D. Crooks and also assigned to Hunter Industries, Inc. The entire disclosure of said U.S. Pat. No. 7,287,711 is hereby incorporated by reference. See also the disclosures of U.S. Pat. Nos. 3,107,056; 4,568,024; 4,624,412; 4,718,605; and 4,948,052, all granted to Edwin J. Hunter, the entire disclosures of which are also hereby incorporated by reference. As explained in U.S. Pat. No. 7,287,711, an output shaft of the gear train reduction 24 drives a set of four gears 30 (FIG. 2A) that are rotatably supported on a pivotally mounted frame (not illustrated) so that they can rock back and forth with the aid of an over-center spring (not illustrated). This allows the two gears 30 on the outer ends of the frame to alternately engage the inside of a bull gear 32 to drive the bull gear 32 in opposite directions. The reversing mechanism 26 allows a user to set the desired size of the arc of oscillation of the nozzle 18 by engaging a manual tool (not illustrated) with the slotted upper end of an arc adjustment shaft (not illustrated) that is accessible through the top-side of the turret 20 and twisting the arc adjustment shaft. The arc adjustment shaft can be manually twisted to change the location of a movable arc adjustment tab (not illustrated) relative to a fixed arc adjustment tab (not illustrated) to set the desired arc of rotation of the nozzle 18. Optionally maintenance personnel can convert the sprinkler 10 to a uni-directional mode in which allows full circle rotation of the nozzle 18. This is also done by manually twisting the arc adjustment shaft until the arc adjustment tabs overlap one another. Alternately, the reversing mechanism 26 may be manufactured to only allow continuous rotation of the nozzle 18 by not installing specific components during manufacturing in which case the remaining components function simply as a gear driven coupling mechanism between the gear train reduction 24 and the nozzle 18.

A cylindrical bull gear stem 36 (FIG. 2A) is rotationally and co-axially coupled with the bull gear 32 and provides an upwardly extending hollow tubular drive shaft that couples to the turret 20. While the bull gear stem 36 is illustrated as being integrally formed with the bull gear 32, these components could be formed as separate parts and joined in any suitable fashion such as by friction, snap fit, gluing or welding. The upper end of the bull gear stem 36 is securely fastened in a centrally located cylindrical sleeve 38 of the turret 20. The upper end of the bull gear stem 36 has an annular groove that receives an annular rib formed on the interior of the sleeve 38. The turret 20 and the nozzle 18 inserted therein are thus supported for rotation relative to the riser 14 and the case 12 by the bull gear stem 36.

The upper end of the bull gear stem 36 (FIG. 2A) terminates closely adjacent to the lower segment of a dog-legged tubular structure 40 located in the turret 20. The lower segment of the tubular structure 40 is cylindrical and centered axially in the turret 20. The nozzle 18 is inserted into the upper inclined, radially extending segment of the tubular structure 40. The interior of the bull gear stem 36 provides a relatively large central passage P that conveys water to the nozzle 18. A vent tube 42 of the remotely vented pressure regulator 28 extends through the center of the passage P of the bull gear stem 36 and through the tubular structure 40 in the turret 20 behind the nozzle 18. The vent tube 42 has a relatively small outer diameter to minimize water flow resistance and partial obstruction of the passage P.

Figure 2B:
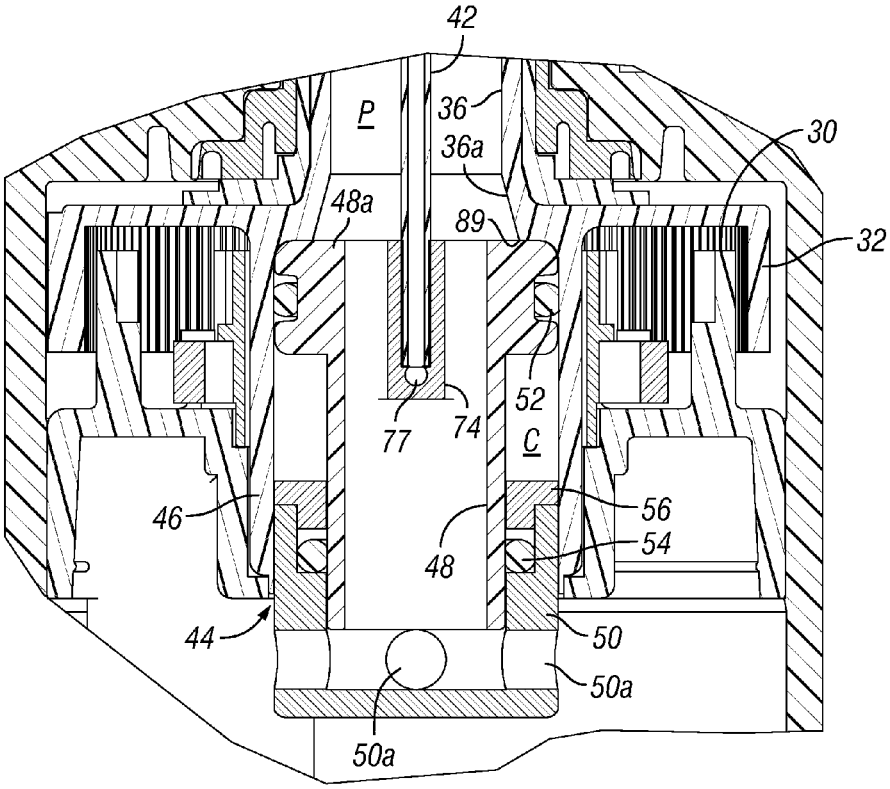
FIG. 2B is further enlarged portion of FIG. 2A illustrating the valve portion of the adjustable pressure regulator in the fully open configuration.
Figure 3:
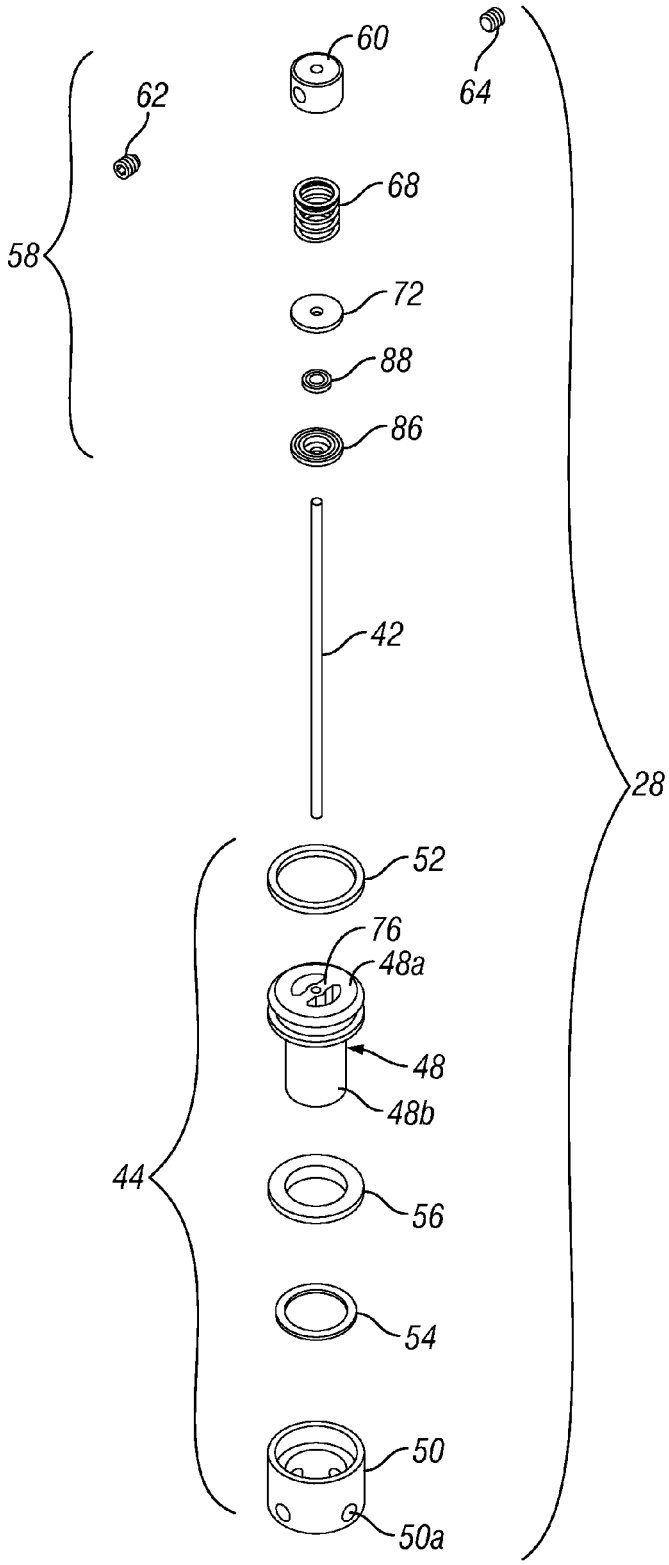
FIG. 3 is an enlarged exploded isometric view of the adjustable pressure regulator of the sprinkler of FIG. 1.

Referring to FIGS. 2B and 3, the remotely vented pressure regulator 28 includes a valve portion 44 that is located in a cylindrical sleeve 46 that extends co-axially and downwardly from the bull gear 32 and is rotationally coupled thereto. While the sleeve 46 is illustrated as being integrally formed with the bull gear 32, these components could be formed as separate parts and joined in any suitable fashion such as by friction, snap fit, gluing or welding. The sleeve 46 effectively forms an extension of the bull gear stem 36. The valve portion 44 includes a cylindrical hollow valve body 48 (FIG. 3) with an enlarged upper head 48*a* and a smaller diameter lower tube 48*b*. The tube 48*b* reciprocates through the round central bore of a cylindrical valve seat 50. The valve seat 50 is snugly fit and/or bonded to the sleeve 46 to fix its vertical position as best seen in FIG. 2B. O-rings 52 and 54 (FIG. 3) surround the upper head 48*a* and the tube 48*b*, respectively, of the valve body 48. As illustrated in FIG. 2B, the O-ring 52 is retained in an annular groove formed in the exterior of the head 48*a* and provides a seal between the head 48*a* and the inner wall of the sleeve 46. The O-ring 54 provides a seal between exterior wall of the tube 48*b* and an interior wall of the valve seat 50. A retainer ring 56 (FIG. 3) surrounds the tube 48*b* and holds the O-ring 54 in position as illustrated in FIG. 2B. The valve seat 50 includes four radially extending round ports 50*a* (FIG. 3) that are spaced apart ninety degrees. The ports 50*a* allow water to flow from the lower part of the riser 14, through the center of the valve portion 44 and then through the passage P to the nozzle 18.

The remotely vented pressure regulator 28 further includes a spring biasing assembly 58 (FIG. 3) that is located in the turret 20 and is operatively connected to the valve portion 44 by the vent tube 42. A cylindrical holder 60 has a central bore that receives the upper end of the vent tube 42 which is secured in place via diametrically extending set screws 62 and 64 or other suitable means. The cylindrical holder 60 can vertically reciprocate in a lower smooth-walled segment of an upper guide sleeve 66 (FIG. 2C) centrally located in the turret 20. A coil spring 68 surrounds the vent tube 42 and is positioned in a lower guide sleeve 70 centrally located in the turret 20. The coil spring 68 is positioned between an upper retention disc 72 and the underside of the holder 60 in a position remotely located away from the valve body 48. The coil spring 68 biases the holder 60 upwardly. The lower end of the vent tube 42 is rigidly secured in a central sleeve 74 (FIG. 2B) of the valve body 48 connected by ribs 76 (FIG. 3) to the upper head 48*a* of the valve body 48. A round vent port 77 (FIG. 2B) extends radially through the lower tube 48*b* of the valve body 48 so that a chamber C inside the sleeve 46 is vented to outside ambient pressure through the vent tube 42.

For an adjustable, or flow shut off version of the regulator, a male threaded cap or screw 78 (FIG. 2C) screws into an upper female threaded segment of the upper guide sleeve 66. The screw 78 has a vertical vent hole 80 that communicates with the interior of the vent tube 42. The screw 78 is formed with a diametric slot 82 so that it can be engaged by a tool (not illustrated) and manually turned to raise and lower its vertical position inside the sleeve 66. The screw 78 is accessible through a hole 83 in an elastomeric cover 84 forming the top-side of the turret 20. The vent tube 42 extends through a beveled lower retention disc 86 seated in the bottom of the lower guide sleeve 70. A small O-ring 88 surrounds the vent tube 42 and is sandwiched between the upper and lower retention discs 72 and 86 to provide a water-tight seal.

Figure 2C:
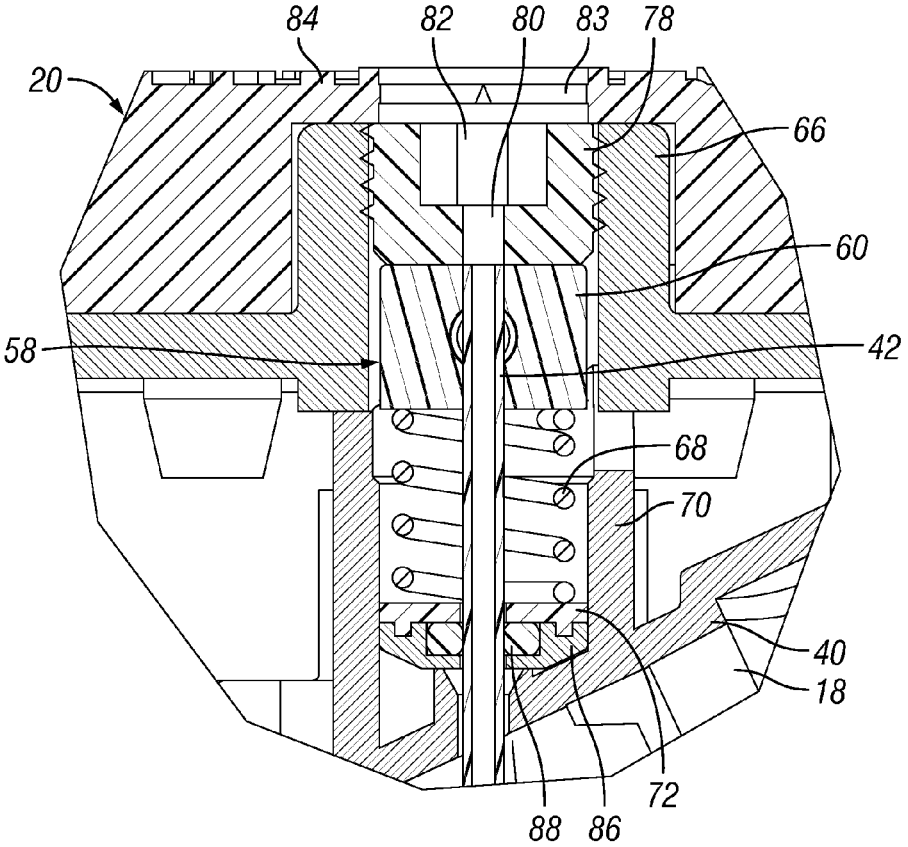
FIG. 2C is further enlarged portion of FIG. 2A illustrating details of the adjusting screw and spring adjusting assembly of the adjustable pressure regulator.

At relatively low water pressure the coil spring 68 biases the holder 60 to its upper position illustrated in FIG. 2C. The vent tube 42 pulls the valve body 48 to its fully open configuration illustrated in FIG. 2B that allows maximum flow since the ports 50*a* are completely unobstructed. When the sprinkler 10 is delivering water through the nozzle 18, water at higher pressure will push down on the upper head 48*a* of the valve body 48 and move the valve body 48 downwardly relative to the valve seat 50, compressing the coil spring 68. This is because the cross-sectional area of the upper head 48*a* is much larger than the cross-sectional area of the bottom end of the relatively thin wall of the lower tube 48*b* of the valve body 48. This is also because the underside of the upper head 48*a* is at atmospheric pressure since the chamber C is vented to the outside of the sprinkler 10 via port 76, vent tube 42 and vent hole 80. The valve portion 44 abuts a shoulder 89 formed at the junction between the bull gear 32, bull gear stem 36 and sleeve 46. Shoulder 89 and upper head 48*a* are formed as a stop that does not create a water tight seal. The flared lower segment 36*a* (FIG. 2B) of the bull gear stem 36 and the-non sealing shoulder 89 ensures that a relatively large area of the upper head 48*a* is exposed to the downward force of the water. As the water pressure increases the valve body 48 will descend further, increasingly obstructing the ports 50*a* of the valve seat 50. At the same time the coil spring 68 is further compressed. The gradual up and down movement of the valve body 48 thus controls the water pressure at the entrance of the tubular structure 40 and at the entrance of the nozzle 18.

Figure 2D:
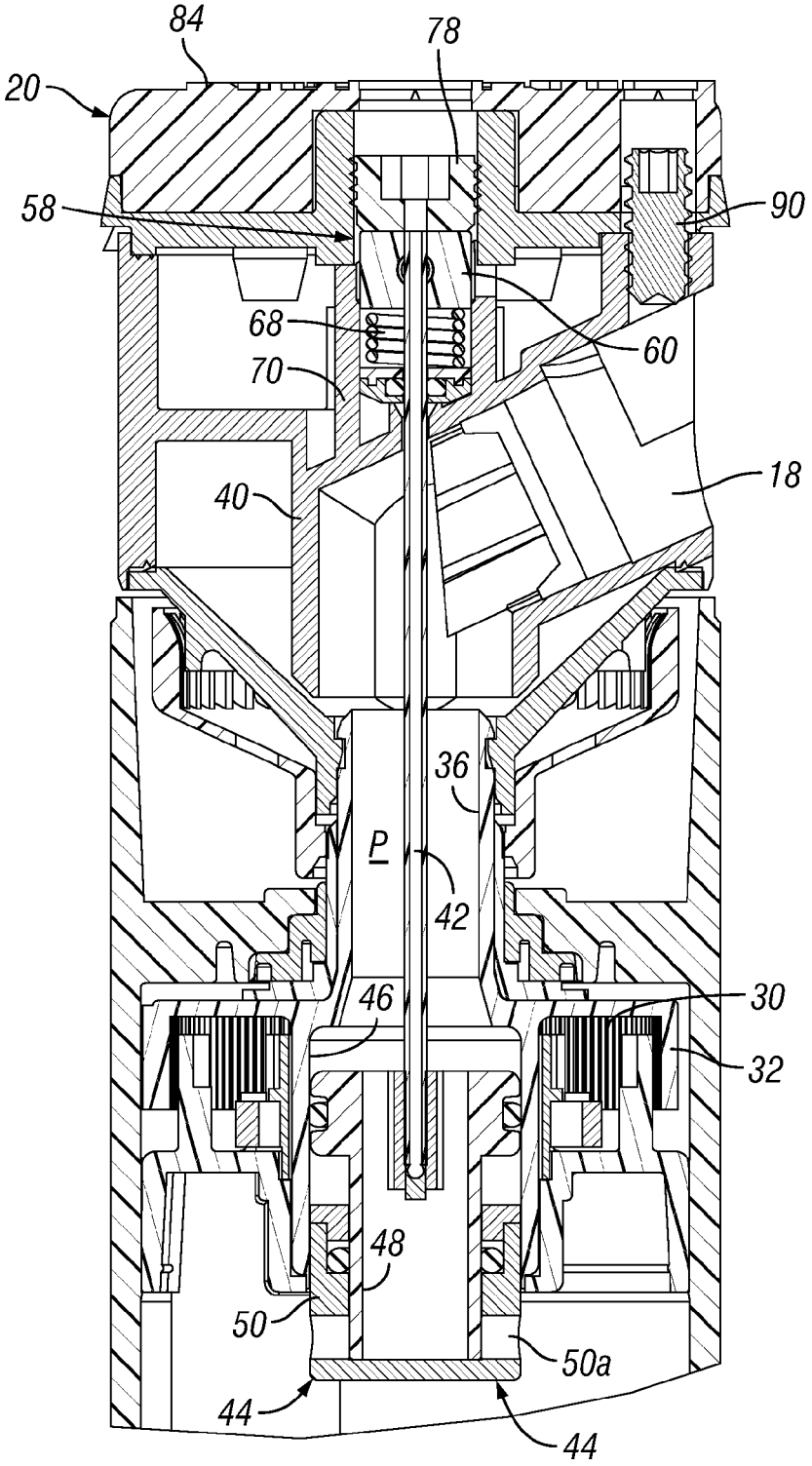
FIG. 2D is a view similar to FIG. 2A with the outer case removed and illustrating the sprinkler of FIG. 1 in its flow shut-off configuration.

Achieving a predetermined water pressure at the entrance of the nozzle 18 requires that the strength of the coil spring 68 be carefully selected. The upper limit of movement of the holder 60 and thus the upper limit of movement of the valve body 48 can be set by manual adjustment of the height of the screw 78. The predetermined maximum pressure of the pressure regulator 28 can thus be manually adjusted from the top-side of the sprinkler 10. The screw 78 can also be turned until it moves the holder 60 to its extreme lower position, compressing the coil spring 68. This same downward movement of the holder 60 moves the valve body 48 to its closed configuration as illustrated in FIG. 2D. The screw 78 then holds the valve body 48 in its fully lowered configuration in which it completely shuts off the ports 50*a* in the valve seat 50 substantially preventing any water from flowing through the valve portion 44. When the water to the sprinkler 10 is ON, the riser 14 will remain in its extended position, allowing the nozzle 18 to be replaced. A non-adjustable pressure regulator can be provided by simply not installing the adjustment screw 78 during assembly.

The size of the orifice in the nozzle 18 is carefully sized and configured to produce the desired flow rate in terms of gallons per hour. See U.S. Pat. No. 5,456,411 granted Oct. 10, 1995 to Loren W. Scott et al., U.S. Pat. No. 5,699,962 granted Dec. 23, 1997 to Loren W. Scott et al. and U.S. Pat. No. 6,871,795 granted to Ronald H. Anuskiewicz on Mar. 29, 2005, the entire disclosures of which is hereby incorporated by reference. The aforementioned patents are also assigned to Hunter Industries, Inc.

Regulating the water pressure adjacent the nozzle 18 results in substantial water savings. The adjustable pressure regulator 28 ensures that the desired amount of water in terms of gallons per hour is distributed onto turf and landscaping by the sprinkler 10 regardless of fluctuations, within a nominal range, in the pressure of the water supplied at the female threaded inlet 12*a*. The pressure of the water supplied by a municipality can vary, for example, from thirty PSI to over 100 PSI. Where the water is pumped from a well, there are also pressure fluctuations. In addition, the water pressure encountered by the sprinkler 10 can vary depending upon how many sprinklers are attached to a given pipe, how far away from the valve the sprinkler 10 is connected to the pipe, and how many sprinklers are connected to the branch pipeline upstream from the sprinkler 10. Moreover, the water pressure at the sprinkler 10 can vary depending on the grade. If the pipe rises in elevation to the location where the sprinkler 10 is connected, the water pressure at the sprinkler 10 will be lower than the sprinkler 10 would if it were connected to the pipe at a lower elevation.

Rotor-type sprinklers that have heretofore included a pressure regulator have located the pressure regulator below the turbine, adjacent to the inlet to the riser. Rotor-type sprinklers have many internal mechanisms inside their risers and the water must flow past many of these mechanisms. Therefore, when the pressure is regulated at the inlet of a rotor-type sprinkler it is difficult to precisely control the pressure at the nozzle. The present invention places the valve portion 44 of the pressure regulator 28 closely adjacent the nozzle 18. By placing the valve portion 44 between the gear train reduction 24 and the nozzle 18 the water pressure is accurately regulated at this critical location, since the flow rate through the nozzle 18 is dependent upon the water pressure at the entrance to the nozzle 18.

Because the valve portion 44 of the pressure regulator 28 is closely adjacent to the nozzle 18 there is no pressure reduction that otherwise may occur when the pressure regulator is located at the inlet end of the riser and the water must thereafter encounter substantial resistance as it flows past the turbine, gears, reversing mechanisms and other components inside the riser 14. Thus the present invention advantageously reduces the water pressure in the vicinity of the inlet of the nozzle 18. High water pressure can be applied at the inlet 12*a* of the case 12 to drive the turbine 22 with a lower pressure resulting at the entrance of the nozzle 18. The present invention also reduces the cost of providing a pressure regulated rotor-type sprinkler compared to the cost of building the pressure regulator into the lower end of the riser 14 adjacent the inlet 12*a* or attaching a separate pressure regulator near the inlet 12*a* but externally of the sprinkler. In addition, the present invention reduces the height otherwise required to provide a rotor-type sprinkler with an internal pressure regulator. For example, the height of the sprinkler 10 may be only four inches compared to a height of six inches if a pressure regulator were incorporated into the sprinkler adjacent the inlet 12*a* or if a pressure regulator were installed externally, directly beneath the sprinkler.

In some cases it may be desirable to reduce the reach of the sprinkler 10 due to the layout of the turf or landscaping being watered. Regulating the water pressure adjacent the nozzle 18 can be used to achieve radius reduction of the sprinkler 10, i.e. a shortening of the stream of water otherwise ejected from the nozzle 18. This results in water savings, which would not result if the radius reduction were achieved by turning a diffusion screw 90 (FIG. 2A) to intercept the stream of water ejected from the nozzle 18.

While we have disclosed an embodiment of a rotor-type sprinkler with a top-side remotely vented pressure regulator, it will be understood by those skilled in the art that our invention can be modified in both arrangement and detail. For example, instead of the staggered gear train reduction 24 the sprinkler 10 could incorporate a planetary gear train reduction. Other forms of reversing mechanism could be used such as a plate with tangential fluid ports and a port shifting mechanism, or a combination planetary gear train reduction and reversing mechanism such as that disclosed in pending U.S. patent application Ser. No. 11/761,911 filed Jun. 12, 2007 of Michael L. Clark entitled "Sprinkler with Reversing Planetary Gear Drive," also assigned to Hunter Industries, Inc., the entire disclosure of which is hereby incorporated by reference. The sprinkler 10 could be sold in a non-telescoping shrub version for mounting on the upper end a long fixed riser in large planter beds or on slopes. The outer case 12 and spring 15 would be eliminated and the riser 14 provided with a female threaded end with radially projecting grasping ribs for screwing to the male threaded upper end of a tall fixed riser. The sprinkler may be a fixed spray type, an impact type, or other style of sprinkler that does not include a gear drive. Therefore the protection afforded our invention should only be limited in accordance with the following claims.

We claim:

1. An irrigation sprinkler, comprising:

a riser;

a nozzle turret rotatably mounted at an upper end of the riser;

a gear train reduction mounted in the riser;

a turbine coupled to the gear train reduction and rotatable by water entering a lower end of the riser;

a gear driven coupling mechanism mounted in the riser and coupling the gear train reduction and the nozzle turret; and a pressure regulator having a valve portion mounted in the riser adjacent a passage that provides a water flow path to the nozzle, the pressure regulator including a valve body movable relative to at least one water flow port to increasingly obstruct the at least one water flow port, a spring connected to bias the valve body to affect a pressure of the water at an entrance of a nozzle in the nozzle turret, and an air flow path separated from the water flow path that vents the valve portion of the pressure regulator to ambient air pressure;

wherein the spring that biases the valve body is mounted in the nozzle turret.

2. The sprinkler of claim 1 wherein the gear driven coupling mechanism includes a bull gear and the valve portion is mounted in a sleeve extending from the bull gear.

3. The sprinkler of claim 1 wherein the gear driven coupling mechanism includes a reversing mechanism.

4. The sprinkler of claim 1 wherein the valve portion includes a valve seat having the at least one water flow port formed therein and the valve body can slide relative to the valve seat.

5. The sprinkler of claim 1 and further comprising a vent tube that extends from the valve body through the nozzle turret and provides the air flow path.

6. The sprinkler of claim 1 and further comprising an adjustment mechanism mounted in the nozzle turret including a screw accessible from a top-side of the nozzle turret and rotatable to reduce an area wetted by the sprinkler.

7. The sprinkler of claim 6 wherein the adjustment mechanism includes a holder mounted for vertical reciprocation in the nozzle turret, the spring biases the holder upwardly, and a vent tube connects the holder and the valve body.

8. The sprinkler of claim 1 wherein the valve portion is mounted between the gear train reduction and the nozzle turret and a vent tube is connected to the valve portion for placing a chamber adjacent the valve portion at ambient air pressure.

9. The sprinkler of claim 6 wherein the screw of the adjustment mechanism can be turned to shut off flow of water through the nozzle.

10. An irrigation sprinkler, comprising:

a riser;

a nozzle rotatably mounted at an upper end of the riser;

a gear train reduction mounted in the riser and coupled to rotate the nozzle;

a turbine coupled to the gear train reduction and rotatable by water entering a lower end of the riser;

an automatic pressure regulator mounted in the riser; and wherein the nozzle is mounted in a turret and the pressure regulator includes a holder mounted for vertical reciprocation in the turret, a spring biasing the holder upwardly, a valve portion mounted in a flow path of the sprinkler above the gear train reduction, and a vent tube connecting the holder and a valve body of the valve portion.

11. The sprinkler of claim 10 wherein the pressure regulator is configured for reducing a radius of a wetted area by reducing a maximum flow of the water entering the nozzle.

12. The sprinkler of claim 10 wherein the valve portion includes a valve seat and the valve body is moveable relative to the valve seat.

13. The sprinkler of claim 10 and further comprising a screw accessible on a top-side of the turret, the screw being manually rotatable to adjust the valve portion.

14. The sprinkler of claim 10 wherein the valve portion is mounted in a sleeve connected to a bull gear.

15. The sprinkler of claim 10 wherein the vent tube is connected to the valve portion for placing a chamber adjacent the valve portion at ambient air pressure.

16. The sprinkler of claim 10 wherein the pressure regulator can be adjusted to shut off flow of water through the nozzle.

17. The sprinkler of claim 10 and further comprising a gear driven coupling mechanism mounted in the riser and coupling the gear train reduction and the turret.

18. The sprinkler of claim 12 and further comprising an O-ring positioned between the valve body and the valve seat.

19. An irrigation sprinkler, comprising:

a riser;

a nozzle rotatably mounted at an upper end of the riser;

a gear train reduction mounted in the riser and having an input shaft;

a turbine coupled to the gear train reduction and rotatable by water entering a lower end of the riser;

a gear driven coupling mechanism mounted in the riser and coupling the gear train reduction and the nozzle;

a pressure regulator mounted in the riser and remotely vented from a top-side of the sprinkler; and wherein the nozzle is mounted in a turret and the pressure regulator includes a holder mounted for vertical reciprocation in the turret, a spring biasing the holder upwardly, a valve portion mounted in a bull gear stem of the gear drive coupling mechanism, and a vent tube connecting the holder and a valve body of the valve portion.

20. An irrigation sprinkler, comprising:

a riser;

a nozzle turret rotatably mounted at an upper end of the riser;

a gear train reduction mounted in the riser;

a turbine coupled to the gear train reduction and rotatable by water entering a lower end of the riser;

a gear driven coupling mechanism mounted in the riser and coupling the gear train reduction and the nozzle turret;

a pressure regulator having a valve portion mounted in the riser adjacent a passage that provides a water flow path to the nozzle, the pressure regulator including a valve body movable relative to at least one water flow port to increasingly obstruct the at least one water flow port, a spring connected to bias the valve body to affect a pressure of the water at an entrance of a nozzle in the nozzle turret, and an air flow path separated from the water flow path that vents the valve portion of the pressure regulator to ambient air pressure; and a vent tube that extends from the valve body through the nozzle turret and provides the air flow path.

21. An irrigation sprinkler, comprising:

a riser;

a nozzle turret rotatably mounted at an upper end of the riser;

a gear train reduction mounted in the riser;

a turbine coupled to the gear train reduction and rotatable by water entering a lower end of the riser;

a gear driven coupling mechanism mounted in the riser and coupling the gear train reduction and the nozzle turret;

a pressure regulator having a valve portion mounted in the riser adjacent a passage that provides a water flow path to the nozzle, the pressure regulator including a valve body movable relative to at least one water flow port to increasingly obstruct the at least one water flow port, a spring connected to bias the valve body to affect a pressure of the water at an entrance of a nozzle in the nozzle turret, and an air flow path separated from the water flow path that vents the valve portion of the pressure regulator to ambient air pressure; and an adjustment mechanism mounted in the nozzle turret including a screw accessible from a top-side of the nozzle turret and rotatable to reduce an area wetted by the sprinkler.

* * * * *